United States Patent [19]

Reeder

[11] Patent Number: 4,620,598

[45] Date of Patent: Nov. 4, 1986

[54] DISPOSABLE FIRE EXTINGUISHER

[76] Inventor: Frank F. Reeder, P.O. Box 532, Princeton, N.J. 08542

[21] Appl. No.: 539,994

[22] Filed: Oct. 7, 1983

[51] Int. Cl.[4] ..... A62C 13/24

[52] U.S. Cl. ..... 169/30; 239/309

[58] Field of Search ..... 239/309; 169/30, 74, 169/75, 71

[56] References Cited

U.S. PATENT DOCUMENTS

| | | | |
|---|---|---|---|
| 2,067,829 | 1/1937 | Denne | 169/30 |
| 2,772,744 | 12/1956 | Beaudet | 169/74 |
| 2,785,759 | 3/1957 | Fleming et al. | 169/75 |
| 2,865,458 | 12/1958 | Simoncini et al. | 169/35 |
| 4,006,780 | 2/1977 | Zehr | 169/74 |

FOREIGN PATENT DOCUMENTS

| | | | |
|---|---|---|---|
| 2001413 | 7/1971 | Fed. Rep. of Germany | 169/75 |

*Primary Examiner*—Joseph F. Peters, Jr.
*Assistant Examiner*—Scott D. Malpede
*Attorney, Agent, or Firm*—Franklyn Schoenberg

[57] ABSTRACT

A portable fire extinguisher apparatus is provided which is disposable comprising (a) a container which is suitable to be grasped in one hand that is adapted to receive fire extinguishing medium under pressure having a sealed outlet port in one end thereof; and (b) discharge means for said container which contains means for permanently opening said sealed outlet port that provides means for directing the flow of fire extinguishing medium dispensed from said container.

17 Claims, 7 Drawing Figures

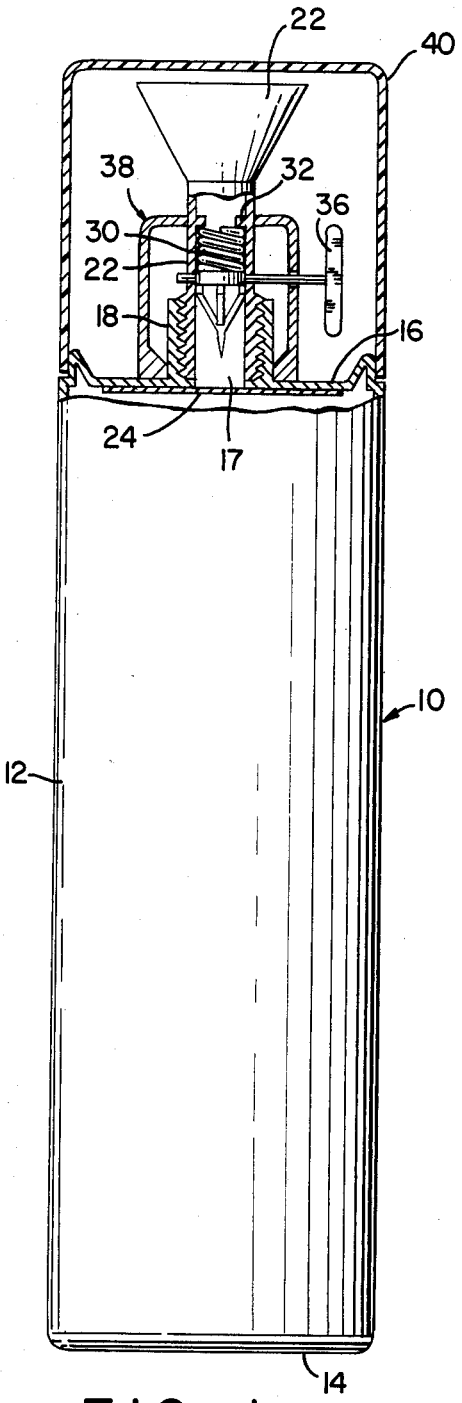
FIG. 1
FIG. 2
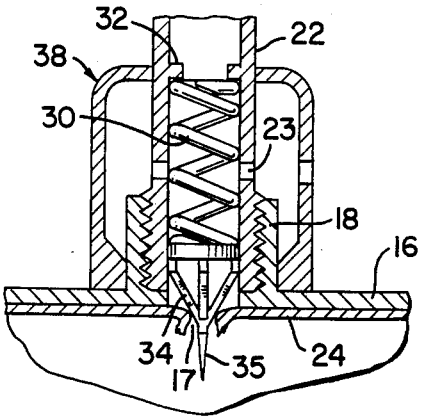
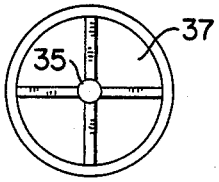
FIG. 3b
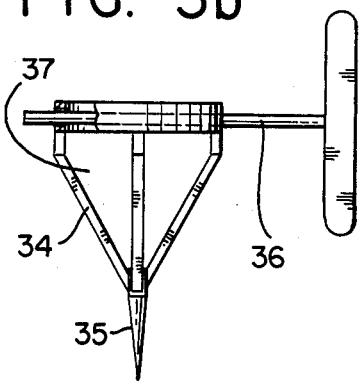
FIG. 3a

FIG. 4
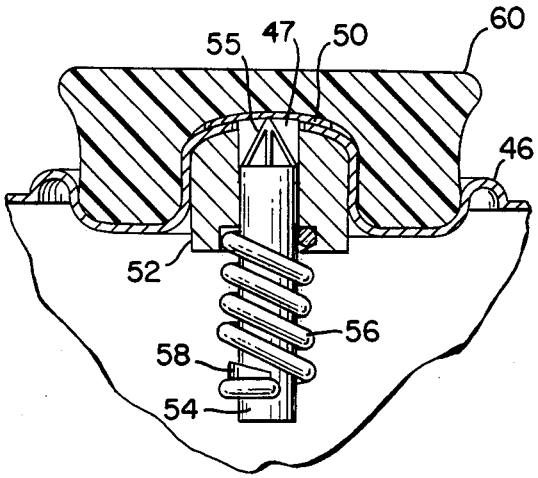
FIG. 5
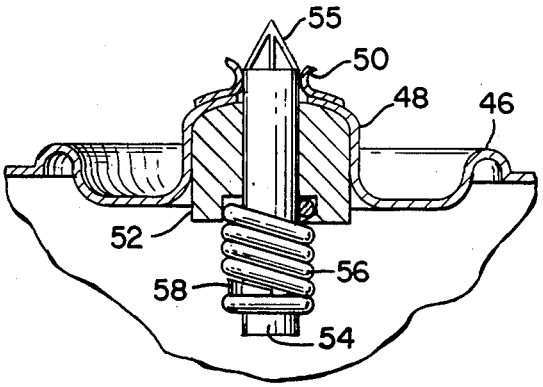
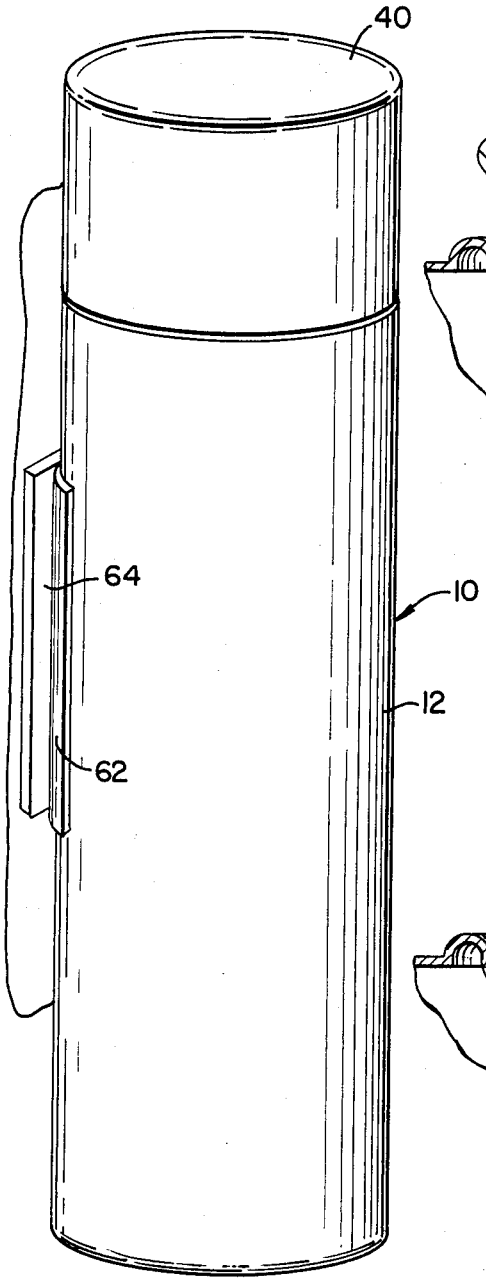
FIG. 6

DISPOSABLE FIRE EXTINGUISHER

FIELD OF THE INVENTION

The present invention relates to a fire extinguisher unit, and more particularly, to improvements in portable fire extinguishers which are suitable for use in the home.

BACKGROUND OF THE INVENTION

Although many fire emergencies occur in the home, relatively few homes are equipped with a fire extinguisher because conventional units are too large or unattractive and therefore not favored in the home, especially in those areas where it is desirable that they be accessible. Moreover, when stored so that they are concealed from view they are apt to be misplaced, not readily accessible, or not properly maintained and, thus, are unavailable for use when actually needed. Similar objections to ready accessibility exist in offices, hotel rooms, etc.

Portable fire extinguishing apparatus which have found wide use contain water or finely divided powder under pressure, or foamable aqueous compositions. In general, the unit includes a tank containing the fire extinguishing medium under pressure, a valve mechanism usually of a pistol grip configuration, and a flexible discharge hose for directing the stream of fire extinguishing fluid when the unit is operated.

Although such fire extinguishers have been used for many years, their basic method of operation have not been significantly changed and the size and weight thereof have not been reduced to a point where aesthetic objections thereto are overcome. Over the years, improvements have been made in the valve mechanisms but they still generally serve as the sealing means for the fire extinguishing medium in the apparatus and require continuous operator control during operation. A flexible discharge hose is the most widely used method of directing the stream of fire extinguishing fluid which also requires attention by the operator. The size and construction of the tank of most commercially available units has also remained substantially unchanged, generally controlled by the theory that it must contain enough fire extinguishing medium under pressure and must be re-usable. Thus, the size, weight, and appearance of the apparatus has generally limited where they can be or will be stored; and in private residences and the like they are usually stored where they are concealed and are not readily accessible where they are needed.

While it is highly desirable that each fire extinguishing unit be capable of effectively extinguishing or substantially controlling the spread of various types of fires that may be encountered, if the apparatus is not immediately available in those locations where a fire emergency may occur or it has not been properly maintained, the usefulness thereof is certainly limited. Thus, it would be highly desirable if a fire extinguishing apparatus was provided that does not require maintenance, could be unobtrusively but conveniently stored in most or all areas, was simple to operate, and each apparatus would provide at least some modicum of immediate protection against a fire emergency.

SUMMARY OF THE INVENTION

In accordance with the present invention there is provided an improved portable fire extinguisher which comprises:

(a) a cylindrical container which is suitable to be held in one hand adapted to receive fluid fire extinguishing medium under pressure having a sealed outlet port in one end thereof; and (b) discharge means for said container which contains means for opening said sealed outlet port, preferably that is protected against inadvertent operation, and provides means for directing the flow of a stream of fluid fire extinguishing medium dispensed from said container.

It has been discovered that the portable fire extinguisher of the invention would be essentially maintenance free, is small enough to be conveniently stored in generally all areas of a private residence and the like, could be easily and safely used with essentially no required effort or training, and would provide sufficient fire control capability for many fire emergencies encountered in residences, hotels, offices, vehicles, etc. Moreover, because of the size of such apparatus, more than one of them may be conveniently provided so that even further protection would be readily available.

BRIEF DESCRIPTION OF THE DRAWINGS

In the drawings:

FIG. 1 is a sectional view in elevation of one embodiment of a fire extinguisher of the present invention;

FIG. 2 is a fragmentary sectional view in elevation on an enlarged scale of the upper header-discharge assembly of the fire extinguisher of FIG. 1;

FIG. 3A is a sectional plan view of the cutting-piercing member of the discharge assembly of FIG. 2.

FIG. 3B is a sectional view in elevation of the cutting-piercing member of the discharge assembly of FIG. 2.

FIG. 4 is a fragmentary sectional view in elevation on an enlarged scale of an alternate embodiment of the upper header discharge assembly of the fire extinguishing of the invention.

FIG. 5 is a fragmentary sectional view in elevation on an enlarged scale of the discharge assembly of the upper header discharge assembly of FIG. 4.

FIG. 6 is a perspective view of the fire extinguisher of the present invention mounted on a wall.

DESCRIPTION OF THE PREFERRED EMBODIMENT

Turning now to the drawings wherein like reference numerals denote like parts, there is shown in FIG. 1 an exemplary embodiment of the fire extinguisher of the present invention designated generally as 10. The fire extinguisher comprises a cylindrical container or cannister 12, preferably seamless in construction, adapted to be held in an individual's hand.

The container or cannister 12 has a flat, closed bottom end 14 and an upper closure or header 16 which is tightly sealed to the container 12. The upper closure 16 is formed with a neck 18 defining a discharge opening 17, which is fitted for receiving a discharge member such as discharge tube 22. Communication between the discharge opening 17 and the interior of the cannister 12 is closed by means of a flat diaphragm 24 formed of a thin metal, plastic or the like which is secured to the underside of the upper closure 16 across the neck 18.

The neck 18 in the upper header 16 is adapted for insertion of a discharge tube 22 through the discharge opening 17. The end of the discharge tube 22 fits inside the neck 18 and is leak tightly secured therein by, for example, a thread-connected therewith.

In FIGS. 1 and 2 is shown in detail one embodiment of the discharge assembly for the cannister 12. Within the end of the discharge tube 22 secured in neck 18 is mounted a coil spring 30 in compression between spring retainer 32 secured in the wall of the discharge tube 22 and a safety pin 36 inserted through the wall of the discharge tube 22. The coil spring 30 is sized to longitudinally expand within the interior of the discharge tube 22. Secured to the downwardly extending end of the coil spring 30 is a conically or cylindrically shaped cutting member 34 which is shaped to form a cutter and/or piercing member 35 for the diaphragm 24. As shown in FIGS. *3a* and *3b*, the cutting member 34 has orifices 37 to provide minimum restriction for the discharge of any fire extinguishing medium contained in the cannister 12.

A dome-shaped cap 38 is frictionally secured to the exterior of the upper closure 16 and about the discharge tube 22. A safety pin 36 extends through the one side of the dome-shaped cap 38 which when inserted through a small aperature 23 in the discharge tube 22 maintains the coil spring 30 within the discharge tube 22 under compression. A cover 40 for the upper end of the cannister 12 is frictionally secured to the top of the cannister to provide added protection for the open end of the discharge tube 22 extending from the top of the cannister 12.

In FIGS. 4 and 5 is shown an alternate embodiment of the upper closure or header 46 of the fire extinguisher of the invention which contains the discharge tube assembly for the cannister 12. In this embodiment, the upper header 46 is formed with a dome-shaped neck 48 which defines a discharge opening 47. Communication between the interior of the cannister 12 and the outside through the discharge opening 47 is sealed off by a diaphragm 50 formed of a suitable thin metal, plastic or the like which is secured over the discharge opening 47 on the outside of the upper closure 46. Within the dome-shaped neck 48 in the upper closure 46 is mounted a discharge tube assembly which includes a connection 52 which is tightly secured within the dome-shaped neck 48 by, for example, a press fit or threaded connection. A discharge member or tube 54 is slidably mounted within the connection 52. A coil spring 56 is mounted under tension about the discharge tube 54 having one end thereof secured in the connection 52 and the other end secured to the discharge tube 54 by a collar 58. Mounted in the outwardly facing end of the discharge tube 54 is a cutting or piercing member 55 through which openings are cut to provide minimum restriction for flow of fire extinguishing medium that would be expelled from the cannister 12.

A safety plug cap 60 which is adapted to make a tight frictional fit about the outside of the dome-shaped neck 48 of the upper closure 46 and the diaphragm closure 50 secured over the discharge opening 47, is frictionally secured to the exterior side of the upper closure 16, thus providing back-up support for the diaphragm closure 50.

Fire extinguishers of the invention could be readily provided with an upper closure or header for said container or cannister 12 containing a discharge assembly having similar cooperating features between opening or rupturing means for a positive closure and means for directing the continuous flow of fire extinguishing medium dispensed by the fire extinguisher which require little or no control by the operator by changes in the configuration of the upper closure or header. Alternatively, it will be understood that the closure means for the cannister can be opened or ruptured directly by action of the operator such as by turning a spigot or valve or pulling off a friction secured cover.

The illustrated fire extinguisher 10 is also preferably of a physical size and weight so that it may be conveniently releasably mounted in substantially any desirable and accessible location in a residence or similar area frequented by individuals. In this connection, there is illustrated in FIG. 6 a fire extinguisher 10 having a velcro strip 62 adhered to the exterior surface thereof. A matching strip of velcro 64 is adhered to a support surface such as the surface of a wall, cabinet, appliance and the like in any convenient location. The fire extinguisher 10 can be readily removed from this mounting whenever needed and is then ready for use in an emergency.

The operation or use of the fire extinguisher 10 of of the invention will be described as the steps using embodiments of the invention illustrated in the drawings. As will be obvious, the particular mechanism illustrated and the method of operation or use is given by way of example only and that some other form of discharge assembly may be provided without departing from the invention.

Normally the extinguisher is mounted in the manner shown in FIG. 6. If the extinguisher is to be used, it is removed from the mounting by simply grasping with one hand and at the same time removing the cover 40. In the embodiment illustrated in FIGS. 1 to 3, the operator simply removes the safety pin 36 and points the discharge tube in the direction of the fire to be extinguished. Removal of safety pin 36 automatically causes the coil spring 30 within the discharge tube 22 to advance the piercing/cutting member 35 through the diaphragm 24. Venting of the fire extinguishing medium which is under pressure within the cannister is thus activated. Directing the flow of the discharging fire extinguishing medium can be simply controlled by the operator as desired, and its delivery requires no further action until all the fire extinguishing medium has been expelled.

In the embodiment illustrated in FIGS. 4 and 5, the the operator simply flips off the friction retained plug cap 60 and points the discharge tube in the direction desired. The sudden removal of the plug cap 60 automatically removes the back-up support for diaphragm 50 and enables the coil spring 56 to advance the discharge tube 54 and piercing/cutting member 55, thus piercing the diaphragm 50. Escape of fire extinguishing medium which is under pressure can be controlled by the operator, as described above, by simply directing the flow thereof as desired until all the fire extinguishing medium has been expelled.

From the foregoing, it is apparent that the invention provides a simple, easily operated, and preferably, disposable fire extinguisher device which is especially useful as an emergency tool for putting out or controlling small fires which most commonly occur in the home. Due to its size and nature of storage as described herein, the apparatus or several of them can be conveniently located in almost any area of a residence, office, hotel room and the like so that it will be readily available where and when needed and is then disposable after use. The apparatus constructed in accordance with the invention requires no maintenance and is generally impossible to be tampered with without the tampering being made evident by, for example, a missing safety pin, premature escaping fire extinguishing medium and the like. This further enhances the value of the apparatus since it insures that the fire extinguisher will always be in condition for immediate use when such a need should arise, or the lack of such readiness would be evident by a cursory inspection. Further, a spent or used fire extinguisher is open to the atmosphere and generally devoid of any retained pressure, and thus easily disposed of.

While in the foregoing specification, embodiments of the invention have been set forth in considerable detail for purposes of making a complete disclosure thereof, it would be apparent to those skilled in the art that various modifications or additions to the preferred embodiments chosen to illustrate the invention may be made without departing from the spirit and principle of the invention.

What is claimed is:

1. An improved portable fire extinguisher apparatus which comprises:

(a) a container which is suitable to be held in one hand adapted to receive fire extinguishing medium under pressure having a sealed outlet port with only one sealing means in one end thereof, said sealing means being secured to the end of said container;

(b) discharge means for said container integrally mounted on the end of said container which contains a conically shaped cutting/piercing member with openings therethrough retained by said discharge means for opening the sealing means in said outlet port without means for restricting the discharge of fire extinguishing medium therethrough, whereby opening said sealing means results in the unrestricted discharge of said fire extinguishing medium until the pressure within said container is substantially vented, and means retained by said discharge means for directing the unrestricted flow of fire extinguishing medium from said container into the atmosphere in a substantially longitudinal direction from the end of said container; and (c) safety means for said sealing means opening member, the removal of which automatically activates said cutting/piercing member without further operator handling.

2. The portable fire extinguisher apparatus according to claim 1 which is disposable after venting the fire extinguishing medium therefrom.

3. The portable fire extinguisher according to claim 2 in which said cutting/piercing member for opening said sealed outlet port is spring actuated.

4. The portable fire extinguisher according to claim 2 in which said discharge means comprises a discharge tube longitudinally interconnected with said outlet port for directing the flow of fire extinguishing medium which contains said cutting/piercing member for opening said sealed outlet port.

5. An improved fire extinguisher comprising in combination:

(a) a container adapted to receive fire extinguishing medium under pressure having a sealed outlet port with only one sealing means in one end thereof, said sealing means being secured to the end of said container:

(b) a conically shaped cutting/piercing member with openings therethrough mounted on the end of said container which is adapted to open said sealed outlet port without means for restricting the discharge of fire extinguishing medium therethrough, whereby opening said sealed outlet port results in the unrestricted discharge of said fire extinguishing medium until the container is vented of substantially all pressure;

(c) a discharge member mounted on the end of said container for directing the unrestricted flow of fire extinguishing medium dispensed into the atmosphere through said outlet port in a substantially longitudinal direction; and (d) safety means for said member adapted to open said sealed outlet port, the removal of which automatically activates said cutting/piercing member without further operator handling.

6. The portable fire extinguisher apparatus according to claim 5 wherein said discharge member comprises a discharge tube interconnected with said outlet port.

7. The portable fire extinguisher apparatus according to claim 5 wherein said discharge member directs the flow of fire extinguishing medium by said container being pointed in a desired direction.

8. The portable fire extinguisher apparatus according to claim 5 wherein said discharge member comprises said cutting/piercing member.

9. The portable fire extinguisher apparatus according to claim 5 wherein said discharge member directs the flow of fire extinguishing medium through said cutting-/piercing member.

10. The fire extinguisher apparatus according to claim 5 wherein said cutting/piercing member is spring actuated.

11. An improved fire extinguisher comprising in combination:

(a) a container adapted to receive fire extinguishing medium under pressure having a closure in one end thereof which is sealed to said container and which has a sealed discharge opening therethrough with only one sealing means, said sealing means comprising a member secured to the closure in the end of said container and bridging the discharge opening therethrough;

(b) a conically shaped cutting/piercing member with openings therethrough integrally mounted on the end closure, said cutting/piercing member being adapted to open said discharge opening sealing means by spring actuating means without restricting the venting of fire extinguishing medium through said discharge opening, whereby opening said discharge opening results in the unrestricted discharge of said fire extinguishing medium until the pressure within said container is substantially vented; and (c) a discharge tube mounted in the end of said container and interconnected with said discharge opening for directing the unrestricted flow of fire extinguishing medium dispensed through said discharge opening into the atmosphere in a substantially longitudinal direction (d) safety means for said member adapted to open said sealed outlet port, the removal of which automically activates said cutting/piercing member without further operator handling.

12. The fire extinguisher according to claim 11 wherein said end closure has a cylindrical neck defining the discharge opening therethrough which is adapted to receive a discharge tube.

13. The fire extinguisher according to claim 12 wherein said discharge tube is retained by the neck in said end closure.

14. The fire extinguisher according to claim 11 wherein said cutting/piercing member is retained by said discharge tube.

15. The portable fire extinguisher apparatus according to claim 1 which is adapted to be releasably mounted on a support surface.

16. The fire extinguisher according to claim 11 which is adapted to be releasably mounted on a support surface and which is suitable to be released from said support surface by grasping in one hand by an operator.

17. The fire extinguisher according to claim 12 wherein said fire extinguisher is released from a support surface without activating the safety means for discharge of fire extinguishing medium therefrom.

* * * * *